US006286824B1

(12) United States Patent
Sagol

(10) Patent No.: US 6,286,824 B1
(45) Date of Patent: Sep. 11, 2001

(54) COLLAPSIBLE WORKTABLE

(75) Inventor: Sami Sagol, Herzlia (IL)

(73) Assignee: Keter Plastic Ltd., Herzlia (IL)

( * ) Notice: Subject to any disclaimer, the term of this patent is extended or adjusted under 35 U.S.C. 154(b) by 0 days.

(21) Appl. No.: 09/430,986

(22) Filed: Nov. 1, 1999

(51) Int. Cl.[7] ..... B25B 1/00
(52) U.S. Cl. ..... 269/99; 269/900; 269/901
(58) Field of Search ..... 108/6, 8; 269/99, 269/901, 900, 79, 244; 144/287; 182/151, 153, 224, 225, 226

(56) References Cited

U.S. PATENT DOCUMENTS 2,707,663 * 5/1955 Wickel ..... 108/6
4,089,522 * 5/1978 Rock ..... 108/6
4,625,951 * 12/1986 Yang ..... 269/901
5,105,862 * 4/1992 Skinner et al. ..... 144/287
5,535,847 * 7/1996 DuRapau ..... 182/153

* cited by examiner

*Primary Examiner*—Robert C. Watson
(74) *Attorney, Agent, or Firm*—Kenyon & Kenyon

(57) ABSTRACT

The invention relates to a worktable mountable on a sawhorse, the sawhorse including two frames articulated to one another along a longitudinal top axis, and a top bar having two side faces extending parallel to the longitudinal axis. The worktable includes a top bar receiving member and at least one work plate articulated thereto, the top bar receiving member including a receiving portion fitted for snugly receiving the top bar and at least one support leg for supporting the at least one work plate at a substantially horizontal position.

23 Claims, 6 Drawing Sheets

COLLAPSIBLE WORKTABLE

FIELD OF THE INVENTION

The present invention is generally in the field of worktables and in paticular it is concerned with such a portable and collapsible worktable.

The term"worktable" as used hereinafter in the specification and claims refers also to"work benches".

BACKGROUND OF THE INVENTION

A myriad of worktables available on the market and many patents are directed to various such worktables, most of which typically comprise a work surface (worktable) and a support structure which in many cases is collapsible.

A variety of patents are concerned with different aspects of the support structure and their collapsing whilst other patents are directed to features of the worktable and different accessories therefor.

It is an object of the present invention to provide a novel worktable which is easily assembled on a support structure and easily removed therefrom for transport and storage.

SUMMARY OF THE INVENTION

According to the present invention there is provided a workable mountable on a sawhorse, the sawhorse comprising two frames articulated to one another along a longitudinal top axis, and a top bar having two side faces extending parallel to said longitudinal axis; the workable comprising a top bar receiving member and at least one work plate articulated thereto; said top bar receiving member comprises a receiving portion fitted for snugly receiving the top bar and at least at one support leg for supporting the at least one work plate at a substantially horizontal position.

The sawhorse as referred to herein in the specification and claims may be a fixed structure or of the type which is collapsible and comprises a pair of side frames which are pivotable about the longitudinal axis and have an operative position wherein the frames diverge at their lower ends for increasing stability, and a collapsed state in which the support frames are essentially parallel with one another for transport and storage.

The top bar of the sawhorse may be integral with the support frames or may be attached thereto (fixedly or removably) and has the purpose of supporting a workpiece while being worked, e.g. lumber, pipes, etc. or a plate of material supported over two such sawhorses serving as a table.

Typically, the top bar generally has a rectangular cross-sectional shape though it may be formed with different grooves and openings for the purpose of supporting workpieces. For example, there may be provided a longitudinal V-like groove or other openings for receiving fixtures, etc.

According to one preferred embodiment the workable comprises two work plates pivotally hinged to the top bar receiving member along axes parallel to a longitudinal axis of the top bar receiving member. Still preferably, the worktable has an operative state wherein the top surface of the work plates extend flush with a top surface of the top bar receiving member, and a collapsed state in which, preferably, the work plates are pivoted about the top bar receiving member into overlapping with one another.

In order to firmly support the work plates, the support leg is articulated at one end thereof to the worktable and has a second end adapted for engagement with a portion of the frame of the sawhorse. Preferably, each work plate is supported by two support legs.

In accordance with a preferred design of the invention the sport legs are swingably articulated at the first end to the respective work plate and preferably the support legs are retained at their collapsed se by a locking arrangement which typically is a snap-lock engagement.

In accordance with a particular and preferred design of the invention, the support legs are swingable between an operative state in which they project downwardly from the work plate, and a collapsed state in which they extend parallel to an edge of the respective work plate.

Preferably the support legs are formed at their second end with a surface for bearing against a corresponding surface at the portion of the respective sawhorse frame. Still preferably, the support legs are formed at their second end with a first engaging member for engagement with a corresponding second engaging member at the portion of the sawhorse frame. By one particular example, the first engaging member is a projection and the second engaging member is a corresponding opening. Removing the worktable from the sawhorse is possible only upon disengaging the first engaging members from the corresponding second engaging members.

In accordance with one desired embodiment, the top bar receiving member is fitted with a vice, the vice comprising an adjusting screw manipulable by a handle, a first jaw, and second jaw facing the first jaw and being displaceable along an axis of said adjusting screw, said screw extending within the top bar receiving member.

One or both of the work plates may be integrally formed with a storage compartment fitted with a closable lid. Such a compartment may be useful for storage of a variety of articles such as, for example screws, nails, drill bits, etc. Furthermore, at least one of the at least one work plates is formed with a plurality of apertures for removably receiving a variety of fixture elements. Such elements may be accessory jaws for the vice, fixed jaws etc. Such elements may be stored within the Storage compartment or within suitable apertures formed at the bottom surface of the work plates.

Preferably the worktable comprises a locking arrangement for securing the work plates in the collapsed state.

In accordance with a preferred design, the top bar receiving portion has a rectangular cross-section with two side walls sized for tightly bearing against the corresponding side faces of the top bar. The extent to which the top bar is received within the receiving portion is controlled by an arrangement according to which the side walls of the top bar receiving portion each, have a bottom edge fitted for bearing against corresponding shoulders laterally projecting from the top bar.

The worktable and the top bar receiving member may be longer than the top bar of the sawhorse. Accordingly, and the top bar receiving portion may be fited with walls conforming the length of the receiving portion with the length of the top bar.

BRIEF DESCRIPTION OF THE DRAWINGS

For better understanding the invention and to see how it may be carried out in practice, the invention will now be described, in a non-limiting manner, with reference to the accompanying drawings, in which.

DETAILED DESCRIPTION OF SPECIFIC EMBODIMENTS

Figure 1A:
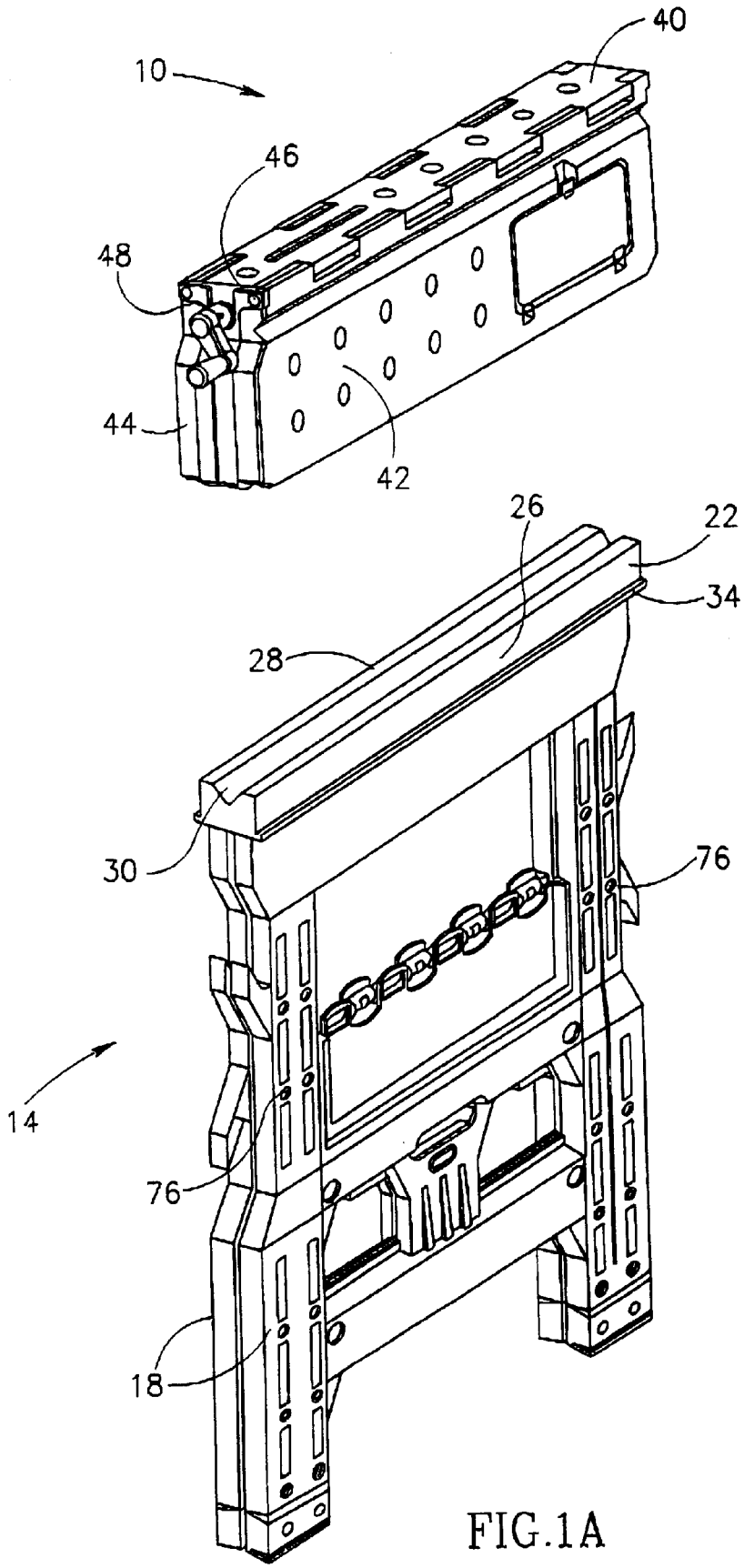
FIG. 1A is an exploded, perspective view of a worktable and of a sawhorse for supporting same, both in their collapsed position.

Attention is first being directed to FIG. 1A showing a worktable generally designated 10 and a sawhorse generally designated 14 for use in conjunction therewith, both shown in their folded or, collapsed position.

Figure 2B:
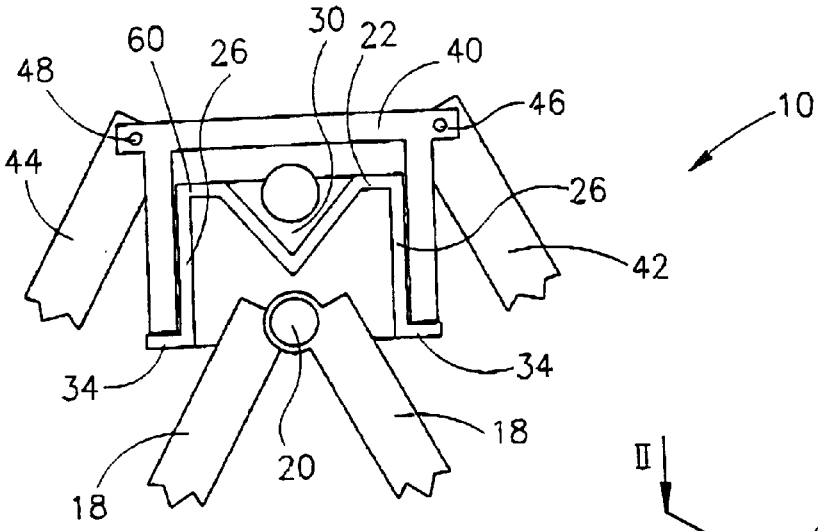
FIG. 2B is a schematic section along line II—II in FIG. 2A.
Figure 2A:
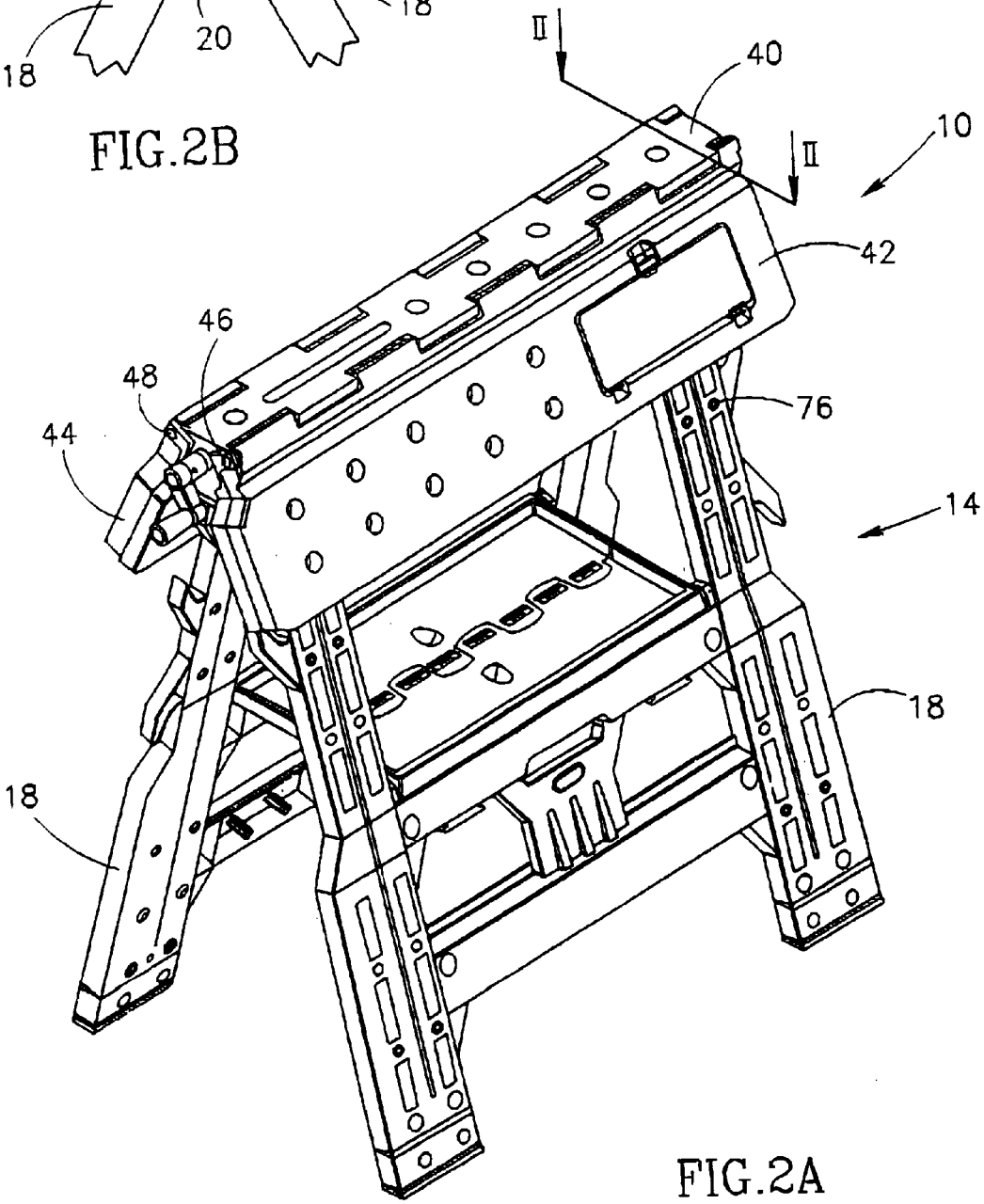
FIG. 2A is a perspective view of the worktable mounted on the sawhorse, prior to setting the worktable into its operative position.

With further reference also to FIGS. 2A and 2B, the sawhorse 14 comprises two frame members 18 pivotally articulated to one another at their top ends through their longitudinal axle 20 (FIG. 2B). A top bar 22 is fixed over the frame members 18 and is articulated to axle 20 in a manner which does not interfere with displacement of the support frames 18 into their converged position seen in FIG. 2A, namely the operative, open position. Top bar 22 has a general rectangular cross-section having two side walls 26 and a top surface 28 (FIG. 1A) formed with a longitudinal V-like shaped groove 30. Each of side walls 26 is formed at a lower edge thereof with a laterally projecting wall portion 34.

In the normal course of operation the sawhorse 14 serves to support a workpiece being worked on, e.g. a piece of wood, a piece of metal, etc. or to support a board of material over two such sawhorses to constitute a table.

Worktable 10 comprises a top bar receiving member 40 and two work plates 42 and 44 hinged to the top bar receiving member at hinges 46 and 48, respectively. In their open, operative position (FIGS. 4,5) the top surfaces of work plates 42 and 44 are flush with a top surface of top bar receiving member 40.

Figure 1B:
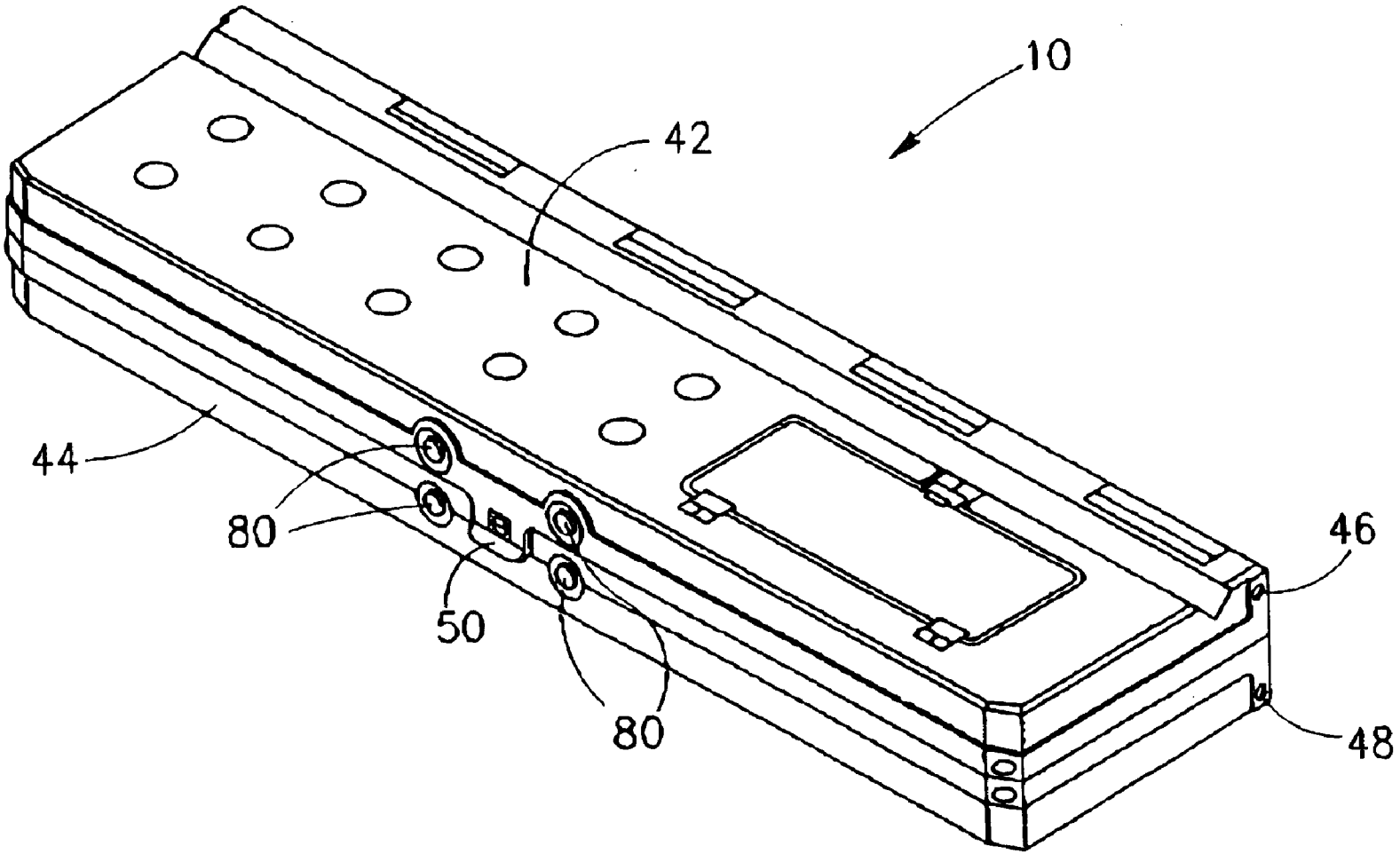
FIG. 1B is a perspective view from a different side of the worktable of the present invention, shown from a different side in order to visualize looking members of the device.
Figure 3:
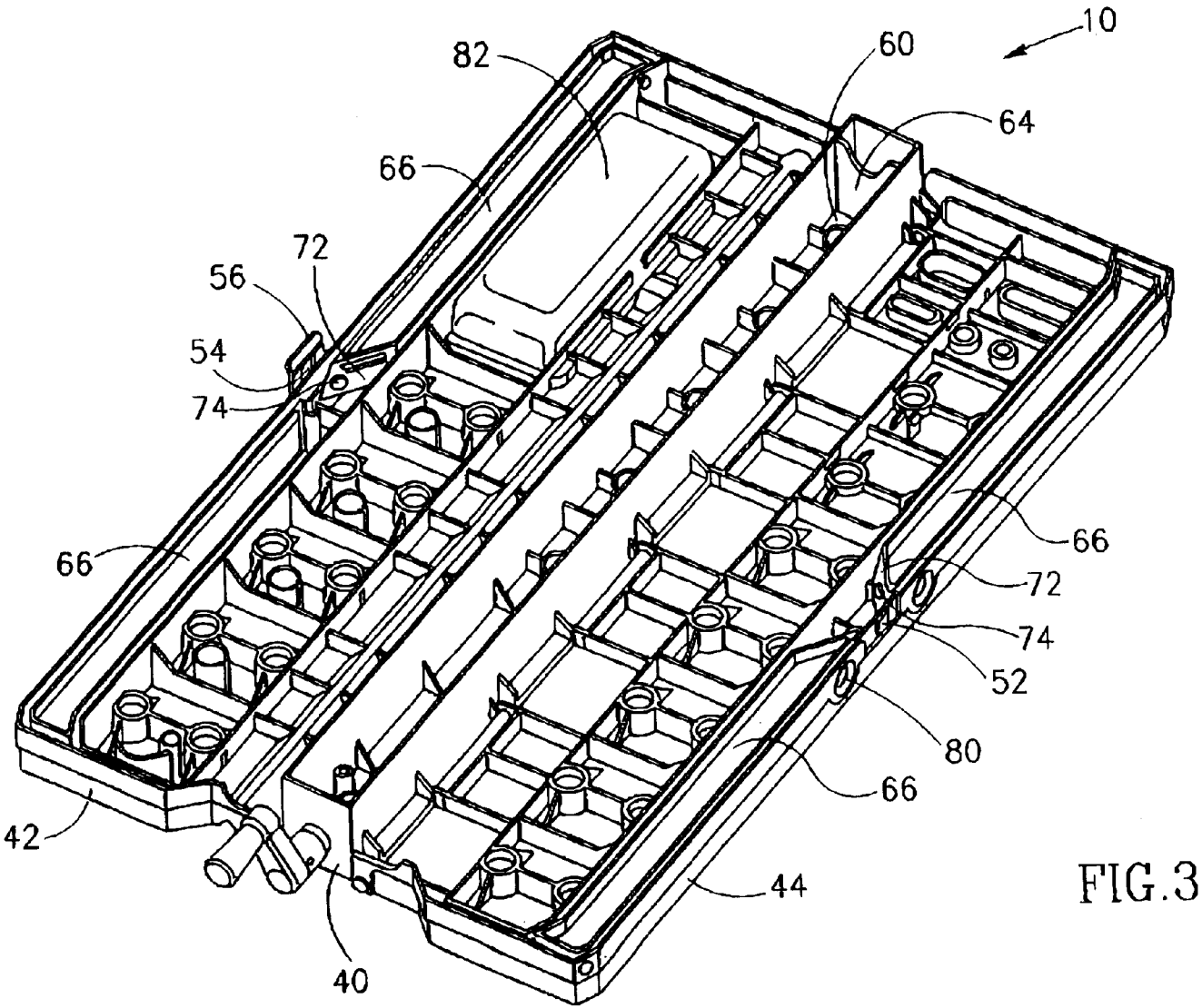
FIG. 3 is a bottom, perspective view of the worktable with the support legs in their collapsed position.

Worktable 10 is retained in its closed position by a snap-type closure arrangement 50 (best seen in FIGS. 1B and 3) wherein a bulge 52 formed at work plate 44 is adapted for snap engagement within an opening 54 of latch 56 integral with work plate 42. With further reference to FIG. 3 and as can be seen clearly in FIG. 2B, the top bar receiving member 40 comprises a receiving portion 60 so as to snugly receive the top bar 22 of the sawhorse 14. Receiving portion 60 is formed with a length adjusting wall member 64 Rig. 3) for adjusting the length of the receiving portion 60 to the actual length of top bar 22 to ensure tight fit and positioning of the worktable in its operative position over the sawhorse.

Figure 4:
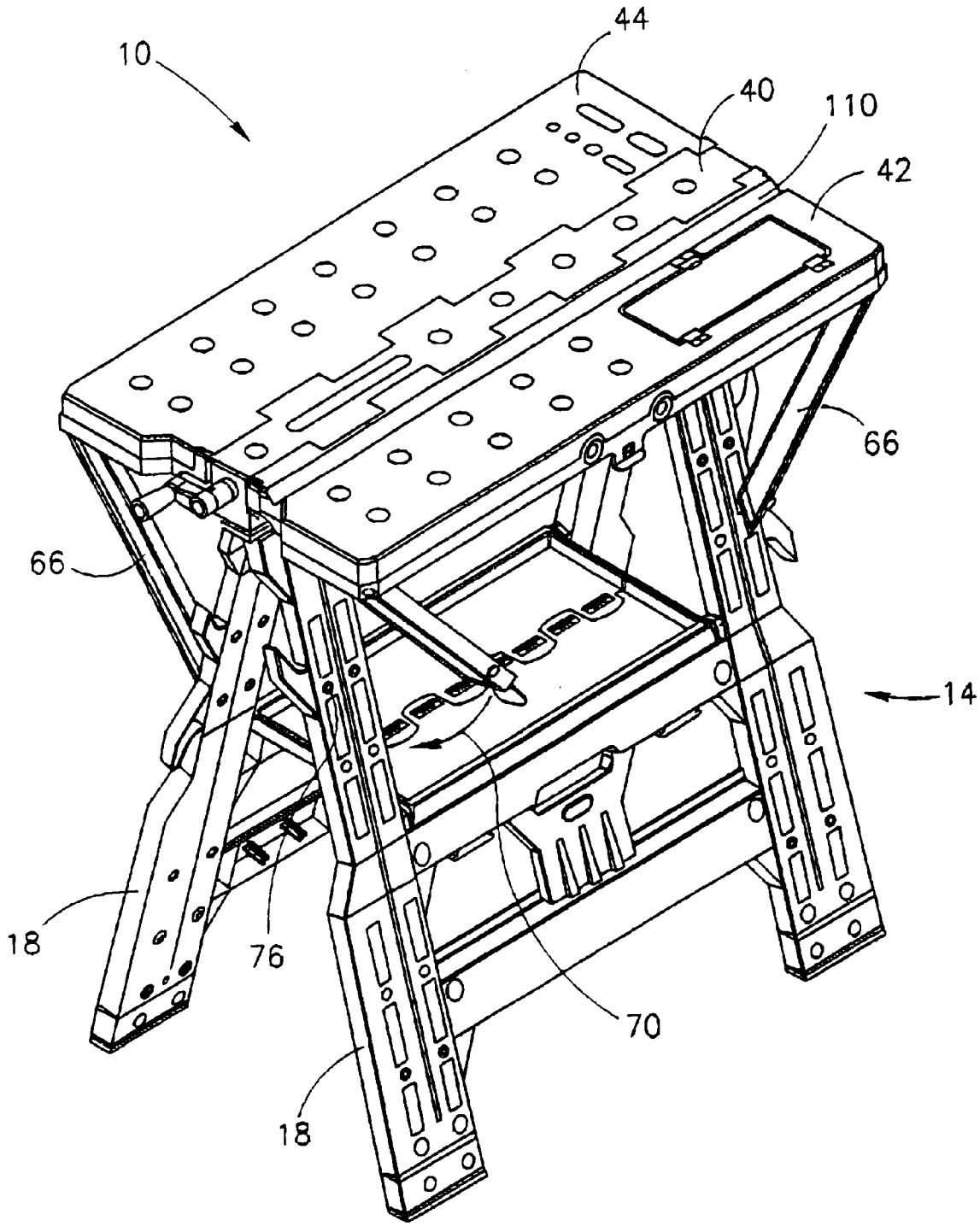
FIG. 4 is a perspective view of the worktable assembled into its operative position.
Figure 5:
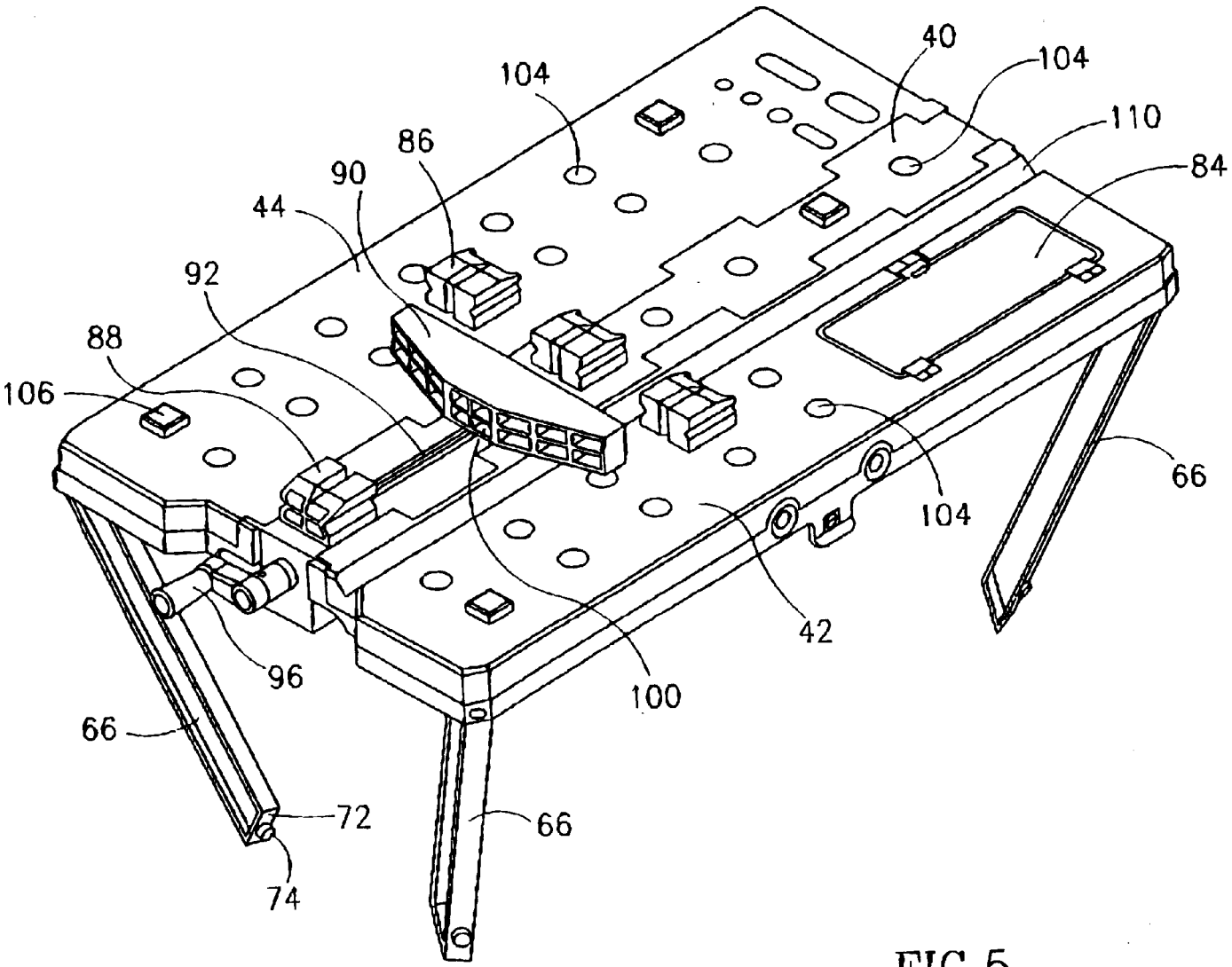
FIG. 5 is a perspective view of the worktable in its open position, with several accessories fitted thereto, the worktable removed from the sawhorse.

As can be seen in FIGS. 3 to 5, each work plate comprises two support legs 66 pivotally fixed at respective corners of the work plate. The support legs are swingable between a storage position seen in FIG. 3 in which the support legs extend adjacent and parallel to edges of the respective work plates 42 and 46, and an open, operative position in which they extend downwards, as seen in FIGS. 4 and 5.

Support legs 66 obtain their operative position of FIGS. 4 and 5 by outwardly swinging in the direction of arrow 70 in FIG. 4.

Each of the support legs 66 is formed at a bottom end thereof with a flat surface 72 from which normally project cylindric engaging members 74.

Each of the legs of the support frames 18 of sawhorse 14 is formed with a plurality of openings of which openings 76 (FIGS. 1A, 2A and 4) are adapted for engagement with projections 74 as will become apparent hereinafter.

Assembling the worktable is obtained by opening the work plates 42 and 44 into the position seen in FIGS. 2, mounting the top bar receiving member 40 over the top bar 22, as seen in FIG. 2B, wherein the latter is snugly received within the receiving portion 60 with bottom edges of the receiving member bearing against lateral portions 34 and then, the support legs 66 are released from their inoperative position by depressing catches 80 (FIGS. 1B, 3) allowing the legs to swing into their extended position along arrow 70 (FIG. 4) whereupon surfaces 72 come to rest over a corresponding flat surface of the frames 18 with projections 74 engaged within openings 76 in a manner in which the worktable becomes engaged with the sawhorse and is ready for work.

The arrangement is such that in the assembled position when the projections 74 are received within corresponding openings 76, the worktable 10 cannot spontaneously disengage from the sawhorse 14 upon elevation of the worktable from the sawhorse owing to the fact that the projections 74 will not disengage from the corresponding openings 76 unless they are intentionally disengaged in a lateral direction.

As can be further seen in the figures and in particular in FIG. 5, work plate 42 is formed with a storage compartment 82 (seen from its bottom in FIG. 3) fitted with a closable lid 84. This storage compartment is useful for storing screws, nails, drilling bits, and other accessories of the worktable, e.g. jaws 86 (seen in FIG. 5). It is noted that lid 84 extends substantially flush with the top surface of work plate 42.

The top bar receiving member 40 is fitted with a vice (FIG. 5) comprising a fixed jaw 88 and a slidable jaw 90 mounted on a manipulating screw 92 operable by a manipulating handle 96. Jaw 90 may be integrally formed over the manipulating screw 92 or may be mounted over an adapter member 100.

The work plates 42 and 44, as well as the top bar receiving member 40 are formed with a plurality of openings 104 for receiving a variety of accessory members such as support jaws 86 and 106, tool holders (not shown), work piece holders (not shown), etc.

Preferably, openings 104 are through going openings whereby the accessory members such as jaws or fixture members 86 may be fixed within such openings when not in use or in the collapsed position of the worktable 10.

As can further be seen, work plate 42 is formed on a top surface thereof with a longitudinal V-like shaped recess 110 useful for working round bars etc.

It will be appreciated that whilst the top surfaces of work plates 42 and 44 as well as the top surface of top bar receiving member 40 are substantially flat, and flush with one another in the operative position (FIGS. 4 and 5), their respective bottom surfaces are ribbed by a plurality of ribs imparting these members mechanical strength.

Whilst preferred embodiments have been shown and described, it is to be understood that it is not intended thereby to limit the disclosure of the invention, but rather it is intended to cover all modifications and arrangements falling within the spirit and the scope of the invention, *mutatis mutandis*.

What is claimed:

1. A collapsible worktable mountable on a collapsible sawhorse, the sawhorse comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg engageable with one of said frames for supporting the at least one work plate at a substantially horizontal position.

2. A worktable mountable on a sawhorse, the sawhorse comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg for supporting the at least one work plate at a substantially horizontal position; the at least one work plate including two work plates pivotally hinged to the top bar receiving member along axes parallel to a longitudinal axis of the top bar receiving member.

3. A worktable according to claim 1, wherein the support leg is articulated at one end thereof to the worktable and has a second end adapted for engagement with a portion of the fame of the sawhorse.

4. A worktable according to claim 1, wherein each of the at least one work plate is supported by two support legs.

5. A worktable according to claim 4, wherein the support legs are swingably articulated to the respective work plate.

6. A worktable mountable on a sawhorse, the sawhorse comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg for supporting the at least one work plate at a substantially horizontal position; wherein the at least one of the at least one work plate is integrally formed with a storage compartment fitted with a lid.

7. A worktable mountable on a sawhorse, the sawhorse comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg for supporting the at least one work plate at a substantially horizontal position; wherein the top bar receiving member is fitted with a vice, the vice comprising an adjusting screw manipulable by a handle, a first jaw, and second jaw facing the first jaw and being displaceable along an axis of said adjusting screw, said screw extending within the top bar receiving member.

8. A worktable according to claim 1, wherein the at least one of the at least one work plate is formed with a plurality of apertures for removably receiving a variety of fixture elements.

9. A worktable according to claim 2, having an operative state wherein the top surface of the work plates extend flush with a top surface of the bar receiving member and a collapsed state in which the work plates are pivoted about the top bar receiving member into overlapping with one another.

10. A worktable according to claim 9, further comprising a locking arrangement for securing the work plates in the collapsed state.

11. A worktable according to claim 9, wherein at the collapsed state the support legs are receivable within spaces under the work plates.

12. A worktable according to claim 5, wherein the support legs are swingable between an operative state in which they project downwardly from the work plate, and a collapsed state in which they extend parallel to an edge of the respective workplate.

13. A worktable according to claim 12, wherein the support legs are retained at their collapsed state by a locking arrangement.

14. A worktable according to claim 3, wherein the support legs are formed at their second end with a surface for bearing against a corresponding surface at the portion of the respective sawhorse frame.

15. A worktable according to claim 3, wherein the support legs are formed at their second end with a first engaging member for engagement with a corresponding second engaging member at the portion of the sawhorse frame.

16. A worktable comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg for supporting the at least one work plate at a substantially horizontal position; wherein the support leg is articulated at one end thereof to the worktable and has a second end adapted for engagement with a portion of the frame of the sawhorse; wherein the support legs are formed at their second end with a first engaging member for engagement with a corresponding second engaging member at the portion of the sawhorse frame; and wherein the first engaging member is a projection and the second engaging member is a corresponding opening.

17. A worktable mountable on a sawhorse, the sawhorse comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg for supporting the at least one work plate at a substantially horizontal position; wherein the at least one of the at least one work plate is formed with a plurality of apertures for removably receiving a variety of fixture elements; and wherein the at least one work plate comprises at a bottom surface thereof a plurality of apertures for storing the fixture elements.

18. A worktable mountable on a sawhorse, the sawhorse comprising two frames articulated to one another along a longitudinal top axis, and a top bar having two side faces extending parallel to said longitudinal axis; the worktable comprising a top bar receiving member and at least one work plate articulated thereto; said top bar receiving member comprises a receiving portion fitted for snugly receiving the top bar and at least one support leg for supporting the at least one work plate at a substantially horizontal position; wherein the top bar receiving portion has a rectangular cross-section with two side walls sized for tightly bearing against the corresponding side faces of the top bar.

19. A worktable according to claim 18, wherein the side walls of the top bar receiving portion each have a bottom edge fitted for bearing against corresponding shoulders laterally projecting from the top bar.

20. A worktable according to claim 17, wherein the top bar receiving portion is longer then the top bar, and where the top bar receiving portion is fitted with walls conforming the length of the receiving portion with the length of the top bar.

21. A worktable according to claim 9, wherein at the collapsed state the top bar receiving member is received between the work plates.

22. A worktable according to claim 7, wherein the handle of the vice is removable.

23. A worktable according to claim 15, wherein removing the worktable from the sawhorse is possible only upon disengaging the first engaging members from the corresponding second engaging members.

* * * * *

UNITED STATES PATENT AND TRADEMARK OFFICE

CERTIFICATE OF CORRECTION

PATENT NO. : 6,286,824 B1
DATED : September 11, 2001
INVENTOR(S) : Sami Sagol

It is certified that error appears in the above-identified patent and that said Letters Patent is hereby corrected as shown below:

Column 1,
Line 12, change “worktables available” to -- worktables are available --.

Column 2,
Line 4, change “sport” to -- support --.
Line 6, change “se” to -- state --.
Line 40, change “Storage” to -- storage --.
Line 50, change “each,” to -- each --.
Line 54, change “Accordingly, and the” to -- Accordingly, the --.
Line 55, change “fited” to -- fitted --.

Column 3,
Line 3, change “looking” to -- locking --.
Line 54, change “Rig. 3” to -- (FIG. 3) --.

Column 6,
Line 23, change “A worktable comprising” to -- A worktable mountable on a sawhorse, the sawhorse comprising --.

Signed and Sealed this

Eighteenth Day of March, 2003

JAMES E. ROGAN
*Director of the United States Patent and Trademark Office*